United States Patent [19]

Ohtani et al.

[11] 3,944,445

[45] Mar. 16, 1976

[54] METHOD OF MAKING PERMANENT MAGNETS OF MN-AL-C ALLOY

[75] Inventors: Tadoa Ohtani; Nobuyuki Kato, both of Katano; Shigeru Kojima, Kyoto; Yoichi Sakamoto, Hirakata; Masaharu Tsukahara, Neyagawa; Kiyoshi Kojima, Hirakata; Isago Konno, Neyagawa; Takao Kubo, Kawachinagano, all of Japan

[73] Assignee: Matsushita Electric Industrial Co., Ltd., Japan

[22] Filed: Oct. 8, 1974

[21] Appl. No.: 513,161

[30] Foreign Application Priority Data

Oct. 19, 1973 Japan ..... 48-118278

[52] U.S. Cl. ..... 148/121; 148/31.55; 148/120; 75/134 M

[51] Int. Cl.[2] ..... H01F 1/00

[58] Field of Search ..... 148/121, 120, 31.55; 75/134 M

[56] References Cited

UNITED STATES PATENTS

| | | | |
|---|---|---|---|
| 2,797,995 | 7/1957 | Morgan | 75/134 M |
| 3,194,654 | 7/1965 | Kaneko | 75/134 M |
| 3,266,954 | 8/1966 | Hokkeling et al. | 148/31.57 |
| 3,661,567 | 5/1972 | Yamamoto | 75/134 M |

*Primary Examiner*—Walter R. Satterfield

*Attorney, Agent, or Firm*—Wenderoth, Lind & Ponack

[57] ABSTRACT

A method of making isotropic Mn-Al-C alloy magnets which comprises the step of subjecting an alloy comprising 71.0% to 73.0% by weight of manganese, (1/10 Mn — 6.6)% to (1/3 Mn — 22.2)% by weight of carbon and the remainder aluminum to plastic deformation at a temperature of 550°C to 780°C.

By utilizing this method, it is possible to obtain isotropic Mn-Al-C alloy magnets having excellent magnetic characteristics, i.e. (BH)max = $2.0 \times 10^6$ G. Oe or more.

4 Claims, 1 Drawing Figure

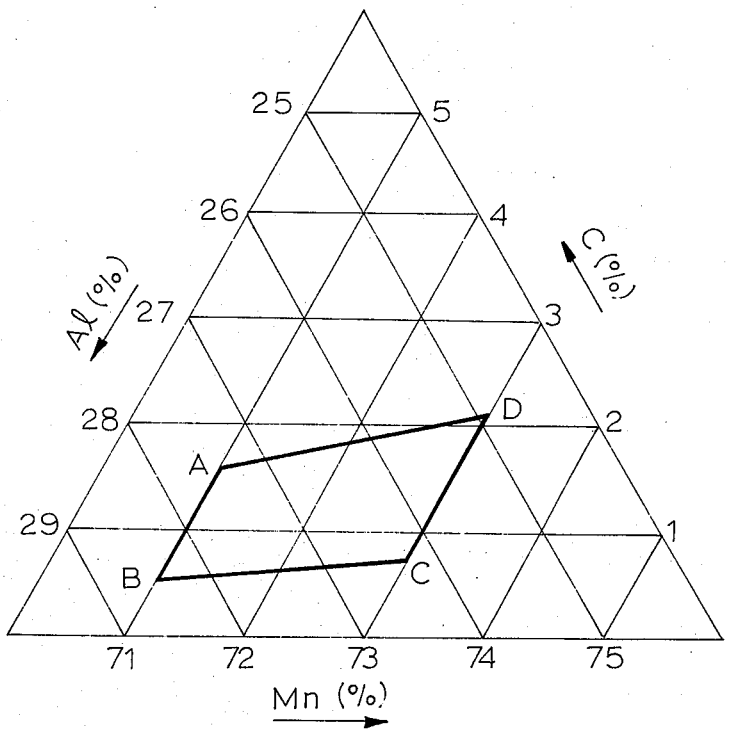
25
5
26
4
27
3
28
2
29
1
A
B
C
D
Al (%)
C (%)
71
72
73
74
75
Mn (%)

METHOD OF MAKING PERMANENT MAGNETS OF MN-AL-C ALLOY

BACKGROUND OF THE INVENTION

This invention relates to a method of making permanent magnets and more particularly to a method of making isotropic permanent magnets of manganese-aluminum-carbon (Mn-Al-C) alloys.

Previously known Mn-Al alloy magnets consisting of Mn 60~75 weight % (hereinafter referred to simply as %) and the remainder aluminum are such that the metastable phase (face-centered tetragonal, lattice constant $a$=3.94A, $c$=3.58A, $c/a$=0.908 and a Curie point of 350° to 400°C; hereinafter referred to as the $\tau$ phase) is obtained by way of a heat treatment such as by the cooling-control method or the quenching-tempering method. The $\tau$ phase is the metastable phase which appears between the high temperature phase (non-magnetic hexagonal structure, lattice constant $a$=2.69A, $c$=4.38A, $c/a$=1.63; hereinafter referred to as the $\epsilon$ phase) and the room-temperature phase in which the alloy is separated into the AlMn($\gamma$) phase (hereinafter referred to as $\gamma$ phase) and the $\beta$-Mn phase (hereinafter referred to as $\beta$ phase). This intermediate phase was discovered by Nagasaki, Kono, and Hirone in 1955. (Digest of the Tenth Annual Conference of the Physical Society of Japan, Vol. 3, 162, October, 1955).

However, the above Mn-Al alloys possess magnetic characteristics which are low, i.e., in the order of (BH)max = $0.5 \times 10^6$ G. Oe, Br = 2200 G, and $_BH_C$ = 600 Oe. Since then, a method has been developed of sintering the powdered alloy in the $\tau$ phase whereby the coercive force is increased by pulverizing; however, the magnetic characteristics of these alloys, at best, were low, being in the order of (BH)max = $0.6 \times 10^6$ G. Oe, Br = 1700 G, and $_BH_C$ = 1250 Oe. Moreover, since the products were formed from powder, their mechanical strengths were low, which make these products impractical for commercial use.

On the other hand, in the attempt to improve the magnetic characteristics of those Mn-Al alloy magnets by making them anisotropic, a method of subjecting the alloy in $\tau$ phase (ferromagnetic phase) to high degree of cold working (hereinafter referred to simply as cold working method), a method of forming in a magnetic field the $\tau$ phase pulverized in cold into powder or the same method followed by sintering (hereinafter referred to simply as in-field powder forming method), etc., were proposed. Because of the difficulties to be described below, these anisotropizing methods have not yet found practical application.

Thus, in the cold working method of anisotropization, because Mn-Al alloy magnets are intermetallic compounds having hard and brittle mechanical properties, even a cold-working of less than 1% causes cracks or fractures in the alloys.

On the other hand, since the degree of anisotropization is dependent upon the degree of cold-working, it is necessary to cold-work the alloy to a high degree, normally higher than 80%, in order to achieve satisfactory magnetic characteristics. For this reason, the Mn-Al alloy will be broken and pulverized in the step of this working.

In order to overcome the difficulties, it is known that rod shaped Mn-Al alloy magnets in the $\tau$ phase are sealed in nonmagnetic stainless steel pipes such as 25Cr-20Ni stainless steel pipe, and while being held in said pipes are subjected to cold working, such as swaging, to a degree of 85~95%. This method is capable of producing an anisotropic permanent magnet possessing magnetic characteristics in the order of Br = 4280 G, $_BH_C$ = 2700Oe, and (BH)max $\approx 3.5 \times 10^6$ G, Oe in the direction of preferred magnetization i.e., the axial direction of the rod. When this method is used, however, due to the intense working, the Mn-Al alloy magnets inside the pipe must be finely pulverized into powder, therefore only a slender bar sealed in stainless steel pipe can be obtained, and moreover, it is difficult to obtain rods of uniform cross-section. The method is therefore costly and of little practical value.

Furthermore, in order to overcome these difficulties, a method has been proposed of obtaining a rod shaped anisotropic Mn-Al alloy magnet by subjecting the $\tau$ phase of the Mn-Al alloy magnet to hydrostatic extrusion at a temperature below 200°C, but the magnetic characteristics of such alloys is low, being in the order of (BH)max = $2.5 \sim 3.6 \times 10^6$ G. Oe in the direction of preferred magnetization. This method also requires very intricate hydrostatic extrusion operation and is again a very impractical method.

On the other hand, the in-field powder forming method is a method whereby after pulverizing the $\tau$ phase (magnetic phase) of the magnet of Mn-Al alloy, the powder is press-formed in a magnetic field. In this instance also, even the best of the values of magnetic characteristics in the preferred direction of magnetization, was of the order of $(BH)_{max} \approx 1.85 \times 10^6$ G. Oe. Moreover, a difficult pulverizing process was required, and the permanent magnet obtained, being a product formed from powder, had the poor mechanical property of being very brittle, detracting from its practical use.

When the hot working, etc., is conducted, Mn-Al alloy has low stability at high temperature of the $\tau$ phase, being the magnetic phase; thus, above 530°C, it undergoes a transformation into the $\gamma$ phase or $\beta$ phase in a short period of time, and at a temperature exceeding 830°C, the transformation proceeds to the $\epsilon$ phase.

Furthermore, the transformation from the $\tau$ phase to the $\beta$ phase is accelerated by the working; thus the so-called strain induced transformation is brought, and as a consequence, all Mn-Al alloys which had been worked at a temperature above 530°C showed markedly lowered magnetic properties, or became nonmagnetic.

The plasticity of Mn-Al alloys above mentioned was found to be based on the high deformability of the $\beta$-phase, and not on the deformability of the $\tau$ phase itself.

As described hereinabove, in the Mn-Al alloys, above 530°C, the transformation to the $\beta$ phase is induced, as the degree of working is increased, to the detriment of its magnetic characteristics.

To replace the Mn-Al alloy magnets mentioned above, there have been invented manganese-aluminum-carbon alloy magnets in bulk shape having excellent magnetically isotropic characteristics, which magnets were disclosed in U.S. Pat. No. 3661567.

Thus, according to the U.S. Pat. No. 3661567, the Mn-Al-C alloy magnets may be multi-component alloys having more then three components, containing impurities or additives other than Mn, Al and C, but should contain carbon as an indispensable component element, and moreover, the component ratio of Mn, Al and C in these multi-component alloys should fall within the following range:

Mn 69.5 ~ 73.0 %
Al 26.4 ~ 29.5 %
C 0.6 ~ (⅓Mn - 22.2) %

Then, only when these alloys are manufactured under the condition restricted as described in the following, the Mn-Al-C alloy magnets may be obtained as isotropic permanent magnets being in bulk form and excelling in their magnetic characteristics, stability, weathering resistance and mechanical strengths.

Thus, Mn, Al and C are so mixed that each component falls within the respective composition range mentioned above, then the mixture is heated to a temperature higher than 1,380°C but lower than 1,500°C, in order to obtain a homogeneous melt with carbon forcibly dissolved therein, and thereafter the molten alloy is cast in a suitable mold. The ingot thus-obtained is heated above 900°C to form its high temperature phase, and then, is quenched by rapidly cooling it from a temperature above 900°C to a temperature below 600°C at a cooling rate of higher than 300°C/min. The quenched alloy is then tempered by heating it at a temperature of 480°~650°C for an appropriate period of time. A Mn-Al-C alloy magnet in bulk shape obtained in this way has magnetic characteristics better than $(BH)max = 1.0 \times 10^6$ G. Oe, while in an isotropic state. This magnetic characteristic runs twice as high as the magnetic characteristics of isotropic Mn-Al alloy magnets.

The present inventors have studied and analyzed the reasons why the magnetic characteristics of Mn-Al-C alloy magnets were improved expecially when the manufacturing conditions were restricted as described hereabove. As a result, it has been clarified that this improvement was due to the particular state of existence of carbon in the Mn-Al-C alloy magnets, i.e., the manufacturing conditions and their magnetic characteristics have an intimate relationship. Accordingly, under manufacturing conditions which make the state of existence of carbon inadequate, magnets having low magnetic characteristics can be produced which are in the same order as isotropic Mn-Al alloy magnets, even if the composition ratio of Mn, Al and C falls within the above mentioned ranges, and even wherein sufficient $\tau$ phase exists.

It was discovered that in order to obtain isotropic permanent magnets from Mn-Al-C alloys having excellent magnetic characteristics, it is necessary that the phases existing in these alloys should mainly include:

1. a magnetic phase having carbon forcibly melted therein beyond the solubility limit, and
2. a phase of $Mn_3AlC$ and/or a face-centered cubic phase resembling such phase in which the remaining excess carbon is separated out by way of tempering in the form of carbides other than aluminum carbide ($Al_4C_3$, etc.) in fine grainy or reticular shape, and that phase (2) is separated and dispersed finely in grainy or reticular form within phase (1) as its matrix. It has been proven that when alloys are produced according to the above-described phase conditions, magnets having greatly improved magnetic characteristics can be manufactured, which alloys possess a stabilized magnetic phase. This state of existence of carbon, as described above, was confirmed by way of X-ray diffraction techniques, optical microscopy and electron microscopy.

$Mn_3AlC$ is a compound having a face-centered cubic crystal structure of a perovskite type (lattice constant $a$ = 3.87A), but because its Curie point is 15°C, and it is nonmagnetic at room temperature, $Mn_3AlC$ itself, even when existing in the Mn-Al-C alloys, does not contribute to the intensity of magnetization of the Mn-Al-C alloy magnets.

A face-centered cubic phase similar to $Mn_3AlC$ means (1) a phase wherein perovskite type carbides appear in the Mn-Al-C alloys containing an amount of carbon beyond than the solubility limit, or (2) is a precipitated substance having the same chemical characteristics as that of said carbides, but not exactly the same structure.

$Al_4C_3$ is a carbide existing in Mn-Al-C alloys containing Mn within the range of 68.0~73.0% and an amount of carbon in excess of (⅓ Mn—22.2)%. It is formed at temperatures above the melting points of Mn-Al-C alloys, but is neither formed nor destroyed by heat treatment in the temperature range below the melting points. $Al_4C_3$, hydrolyzed by moisture in the air, etc., causes the alloys to crack, leading finally to the decay of alloys with the further proceeding of hydrolysis.

It has been clarified that in Mn-Al-C alloys, the solubility limit of carbon in the magnetic phase, as determined by the measurement of lattice constants by way of X-ray diffraction and by measurement of Curie point by use of a magnetic balance, is 0.7% for the composition of 73% Mn, 0.5% for the composition of 71% Mn, and the solubility limit of carbon within the composition range of 71.0~73.0% Mn can be represented by the mathematical formula of (1/10 Mn — 6.6)%.

On the other hand, the solubility limit of carbon in the high temperature phase is almost the same as the solubility limit of carbon in the magnetic phase at a temperature of 830°C, but in a temperature range of 900°C~1200°C, the solubility limit of carbon in this phase is (0.8~2.0)% of carbon; however, by quenching at a temperature above 900°C, a high temperature phase can be obtained in which more than (1/10 Mn — 6.6)% of carbon is forcibly dissolved. When, however, in the process of quenching from a temperature above 900°C, a gradual cooling is made at a cooling rate lower than 10°C/min. in the temperature range of 830°~900°C, and then, quenching is carried out from this temperature, or when the alloys are held in the temperature range at 830°~900°C for more than 7 minutes, preferably more than 10 minutes, and quenching from that temperature, $Mn_3AlC$ precipitates in lamellae in a $\epsilon$ phase. The deposition of $Mn_3AlC$ in lamella is oriented parallel to the special crystal plane of the $\epsilon$ phase, i.e., (0001) plane, and has the orientation relationship of $$\epsilon(0001) \,//\, Mn_3AlC\ (111)$$

as evidenced by optical microscopic observation and X-ray diffraction of a single crystal as the test specimen.

On the other hand, by subjecting the high temperature phase into which carbon has been forcibly dissolved to the aforementioned tempering at 480°~650°C, a phase of $Mn_3AlC$ and/or face-centered cubic phase resembling such phase is deposited, finely dispersed in the matrix of the magnetic phase into which free carbon more than the solubility limit has been forcibly contained.

The composition range of U.S. Pat. No. 3661567 refers to the most typical composition range, where the state of existence of carbon is concerned, and it was clarified that the excess carbon in the composition range especially of Mn more than 70% exists as the phase of $Mn_3AlC$ and/or the face-centered cubic phase resembling such phase which has been deposited, finely dispersed in the grainy or reticular shape. The magnetic characteristic of the Mn-Al-C alloy obtained in this way is isotropic in the bulk state, with (BH)max running above $1.0 \times 10^6$ G. Oe.

The present inventors invented anisotropic Mn-Al-C alloy magnets which are superior to the isotropic Mn-Al-C alloy magnets of U.S. Pat. No. 3,661,576. Inventions concerning anisotropic Mn-Al-C alloy magnets were disclosed that:

1. Excellent anisotropic magnets can be obtained by subjecting an alloy containing a composition of Mn 68.0~73.0%, C(1/10 Mn — 6.6)%~ (⅓ Mn — 22.2)% and the remainder aluminum to plastic deformation at the temperature range of 530~830°C after precipitating the phase of $Mn_3AlC$ and/or face-centered cubic phase resembling such phase into plane (0001) of the high temperature phase.
2. Excellent anisotropic magnets can be obtained by subjecting a polycrystalline alloy containing Mn (68.0~70.5)%, C(1/10 Mn — 6.6)%~(⅓ Mn — 22.2)% and the remainder aluminum, to a quench treatment at a cooling rate higher than 10°C/min. in the temperature range of 830°~900°C, then, tempering at the temperature of 480°~750°C and subjecting to plastic deformation at the temperature of 600°~780°C after the tempering.

SUMMARY OF THE INVENTION

This invention relates to a method of making isotropic Mn-Al-C alloy magnets, which method was obtained as a result of further detailed survey on the above-mentioned invention.

Accordingly, it is an object of this invention to provide a method of making isotropic Mn-Al-C alloy magnets having magnetic characteristics such that the (BH)max is above $2.0 \times 10^6$ G. Oe and which reaches to $2.5 \times 10^6$ G. Oe in the bulk state.

It is another object of this invention to provide a method for making very excellent isotropic permanent magnets which exhibit a specific gravity as low as 5.1 and which have magnetic energies per unit weight comparable to those of the highest class of known permanent magnets, e.g., having energies per unit weight 2 times higher than those of isotropic (Ba, Sr) ferrite magnets and AlNiCo magnets.

It is a further object of this invention to provide a method of making isotropic permanent magnets having excellent mechanical characteristics.

The present inventors have found out that, in the restricted composition range represented by Mn 71.0~73.0%, C(1/10 Mn — 6.6)~(⅓ Mn — 22.2)% and the remainder Al, i.e., in the composition range enclosed by the line connecting the points A, B, C and D, as shown in the ternary composition diagram of Mn-Al-C alloys of the drawing, isotropic Mn-Al-C alloy magnets may be obtained. The $\tau$ phase of these magnets which has been obtained by quenching at a cooling rate higher than 10°C/minute in the temperature range of 830°~900°C, and then tempering at 480°~750°C for an appropriate period of time, is not only highly stable, but also does not undergo the strain-induced-transformation to the $\beta$ phase, when further subjected to the plastic working in the temperature range of 550°~780°C. Moreover, in which their magnetic characteristics are unexpectedly improved. Other and further objects, features and advantages of the invention will appear more fully from the following detailed description and Examples.

BRIEF DESCRIPTION OF THE DRAWINGS

The drawing represents a composition diagram of a Mn-Al-C ternary system.

DESCRIPTION OF THE PREFERRED EMBODIMENT

In the following, this invention is further detailed in reference to scores of its embodiments:

EXAMPLE 1

The raw materials of Mn, Al and C were properly mixed, were melted at about 1,450°C in 30 minutes, thereby melting carbon fully into its solid solution, and were then, cast to form a rod shape casting of a Mn-Al-C alloy. The compositions of the castings thus obtained were as shown in Table 1 in terms of the value of its chemical analysis.

Table 1

| Test Specimen No. | Mn % | Al % | C % |
|---|---|---|---|
| 1 | 69.52 | 29.89 | 0.59 |
| 2 | 70.47 | 28.72 | 0.81 |
| 3 | 70.83 | 28.32 | 0.85 |
| 4 | 71.03 | 28.05 | 0.92 |
| 5 | 71.05 | 27.59 | 1.36 |
| 6 | 71.24 | 27.81 | 0.95 |
| 7 | 71.47 | 27.80 | 0.73 |
| 8 | 71.51 | 27.46 | 1.03 |
| 9 | 71.99 | 27.46 | 0.55 |
| 10 | 72.03 | 26.94 | 1.03 |
| 11 | 72.05 | 26.03 | 1.92 |
| 12 | 72.50 | 26.79 | 0.71 |
| 13 | 72.77 | 25.94 | 1.29 |
| 14 | 72.98 | 25.69 | 1.33 |
| 15 | 72.96 | 25.16 | 1.88 |
| 16 | 73.17 | 25.50 | 1.33 |
| 17 | 73.45 | 25.10 | 1.45 |

From each of these castings, a test specimen cylindric in shape of 20mm$\phi$ × 35mm was cut off, was turned into the uniform $\epsilon$ phase by way homogenization by heating at 1,150°C for 2 hours and then quenching from 1,000°C at a cooling rate higher than 10°C/min.

Those test specimens were tempered in the temperature range of 480°~830°C. The magnetic properties appreciably decreased above 780°C in all test specimens of Nos. 1 – 17. The temperature range where the $\tau$ phase stably existed greatly varied depending on the composition; when the tempering time length was 30 minutes, it was below 750°C.

After tempering at 700°C for 30 minutes, each test specimen was examined by X-ray diffraction and optical microscope to determine its phase structure. The results were as follows:

1. In test specimens of Nos. 9, 16 and 17 large amounts of $\beta$ phase was recognized.
2. In test specimens, except those of (1), $\tau$ phase was recognized on the main, but in test specimen of No. 11, $Al_4C_3$ was recognized, and this test specimen began disintegrating several weeks thence.

Moreover, in test specimens of Nos. 4, 5, 6, 7, 8, 10, 12, 13, 14 and 15, precipitation of $Mn_3AlC$ in fine grainy or reticular shape was notably recognized and in test specimens of Nos. 2 and 3 precipitation of $Mn_3AlC$ was slightly recognized.

Test specimens after tempering at 700°C for 30 minutes were upset at 700°C by an upsetting pressure of 12.5 tons at a deformation ratio (reduction of length) of 50%, using a oil-hydraulic press machine. From test specimens obtained in this way, cubic test pieces of 10 × 10 ×mm were cut out, and then, its magnetic characteristics were measured.

Magnetic characteristics in the compressive direction, axial direction of the test specimens, were as shown in Table 2, and in the perpendicular direction to compressive direction; radial direction of test specimens, were as shown in Table 3.

Moreover, it was confirmed by way of X-ray diffraction and optical microscopic observation after working, that test specimens Nos. 9, 16 and 17 comprised the $\beta$ phase and the other specimens comprised only $\tau$ phase on the main.

Table 2

| Sample No. | Br (G) | $_BH_C$ (Oe) | (BH)max × $10^6$ G.Oe |
|---|---|---|---|
| 1 | 2450 | 1350 | 0.9 |
| 2. | 2600 | 1400 | 1.1 |
| 3. | 2850 | 1500 | 1.3 |
| 4. | 3300 | 2100 | 2.0 |
| 5. | 3300 | 2150 | 2.0 |
| 6. | 3350 | 2200 | 2.1 |
| 7. | 3400 | 2350 | 2.2 |
| 8. | 3400 | 2400 | 2.2 |
| 9. | 2700 | 1200 | 0.9 |
| 10. | 3450 | 2500 | 2.3 |
| 11. | 2950 | 2250 | 1.7 |
| 12. | 3350 | 2300 | 2.1 |
| 13. | 3300 | 2400 | 2.1 |
| 14. | 3200 | 2400 | 2.1 |
| 15. | 3100 | 2450 | 2.0 |
| 16. | 2450 | 1300 | 0.8 |
| 17. | 1900 | 750 | 0.5 |

Table 3

| Sample No. | Br (G) | $_BH_C$(Oe) | (BH)max × $10^6$ G.Oe |
|---|---|---|---|
| 1. | 5300 | 2450 | 5.1 |
| 2. | 3650 | 2300 | 2.4 |
| 3. | 3350 | 1950 | 1.9 |
| 4. | 3300 | 2100 | 2.0 |
| 5. | 3300 | 2150 | 2.0 |
| 6. | 3350 | 2200 | 2.1 |
| 7. | 3400 | 2350 | 2.2 |
| 8. | 3400 | 2400 | 2.2 |
| 9. | 2700 | 1200 | 0.9 |
| 10. | 3450 | 2500 | 2.3 |
| 11. | 2950 | 2250 | 1.7 |
| 12. | 3350 | 2300 | 2.1 |
| 13 | 3300 | 2400 | 2.1 |
| 14. | 3200 | 2400 | 2.0 |
| 15. | 3100 | 2450 | 2.0 |
| 16. | 2450 | 1300 | 0.8 |
| 17. | 1900 | 750 | 0.5 |

In test specimen of No. 11, $Al_4C_3$ was recognized, and this test specimen began disintegrating several weeks thence.

Compositions of specimens being isotropic and having magnetic characteristics of (BH)max = more than 2.0 × $10^6$ G. Oe, are within the composition range of Mn 71.0~73.0%, C (1/10 Mn — 6.6)~(⅓ Mn—22.2)% and the remainder Al, that is the composition range enclosed by the line connecting the points A, B, C and D, as represented in the Mn-Al-C ternary composition diagram of the drawing.

Those specimens, i.e., specimens of Nos. 4, 5, 6, 7, 8, 10, 12, 13, 14 and 15 were additionally tempered at 550°C for 30 minutes after subjecting them to working. The magnetic characteristics obtained as a result were improved by about 10%. For example, the specimen of No. 10 after additional tempering was conducted, was isotropic, and its magnetic characteristics both in the compressive direction and in right angles to compressive direction were found to be:

Br = 3500 G, $_BH_C$ = 2600 Oe, (BH)max = 2.5 × $10^6$ G. Oe

Moreover, specimens of Nos. 4, 5, 6, 7, 8, 10, 12, 13, 14 and 15 were markedly improved in mechanical strength by subjecting them to warm plastic working. Its mechanical strength was as follows: tensile strength = more than 40 kg/mm², elóngation = more than 5%, transverse strength = more than 50 kg/mm². Also, those specimens have excellent machinability which make it possible to apply the machining such as conventional lathing in magnetized condition thereof.

EXAMPLE 2

The test specimen No. 10 of Example 1 was subjected to homogenization and quenching treatment similarly as in Example 1 and to a tempering at 600°C for 30 minutes after the quenching, and upset in the same way as in Example 1 with varying working temperature. The magnetic characteristics in the compressive direction and at right angles to compressive direction, i.e., radial direction and tangential direction after this working was carried out were the same and isotropic, as shown in Table 4.

Table 4

| Code | Working Temperature | Br(G) | $_BH_C$(Oe) | (BH)max × $10^6$ G. Oe |
|---|---|---|---|---|
| a | 500 | — | — | — |
| b | 530 | 3150 | 1350 | 1.5 |
| c | 540 | 3300 | 1750 | 1.8 |
| d | 550 | 3400 | 2000 | 2.0 |
| e | 600 | 3450 | 2400 | 2.2 |
| f | 650 | 3450 | 2500 | 2.3 |
| g | 700 | 3450 | 2500 | 2.3 |
| h | 750 | 3400 | 2500 | 2.3 |
| i | 780 | 3100 | 2400 | 2.0 |
| j | 790 | 2850 | 1500 | 1.3 |
| k | 800 | 1900 | 800 | 0.6 |

Range of working temperature in which the test specimens having magnetic characteristics (BH)max = more than 2.0 × $10^6$ G. Oe were obtained was 550°~780°C.

Furthermore, at an working temperature below 540°C, there existed the cracks in some test specimens because of its low deformability. Especially, at temperatures below 500°C, all test specimens were pulverized, so that no test pieces for the measurement of magnetic characteristics could be taken.

In the temperature range exceeding 780°C, in all test specimens, $\beta$ phase was recognized in large amount, as confirmed by the X-ray diffraction.

When the tempering temperature was varied in the range of 480°~750°C, same result was obtained.

Moreover, test specimens of Nos. 4, 5, 6, 7, 8, 12, 13, 14 and 15 in Example 1, have same tendency as mentioned above. When Mn-Al-C alloys comprising Mn 71.0~73.0%, C (1/10 Mn — 6.6)~(⅓ Mn — 22.2)% and the remainder Al, were quenched at a cooling rate higher than 10°C/min after homogenization, and then, were subjected to plastic working after the tempering at temperature of 480°~750°C, isotropic magnet having magnetic characteristic of (BH)max = above $2.0 \times 10^6$ G. Oe could be obtained.

EXAMPLE 3

The test specimen of No. 10 of Example 1 was subjected to homogenization and quenching treatment and to a tempering at 700°C for 30 minutes after a quenching, and was die-upset by an upsetting pressure of 12.5 tons, using die of 40mm$^{\phi}$. The test specimen obtained by above-mentioned working, could be formed perfectly. Its magnetic properties were isotropic and its magnetic characteristics were as follows:

Br = 3450 G $_{B}H_{C}$ = 2550 Oe (BH)max = $2.4 \times 10^6$ G. Oe

Moreover, test specimens subjected to above-mentioned treatment and formed by die-upsetting to other shapes, that is rectangular shape or any other shapes with different cross-sections, showed same magnetic properties and characteristics as mentioned above.

Aforementioned test specimens were subjected to additional tempering at 550°C for 30 minutes after the working, and its magnetic characteristics were found to be:

Br = 3500 G $_{B}H_{C}$ = 2600 Oe (BH)max = $2.5 \times 10^6$ G. Oe

EXAMPLE 4

The test specimen of No. 8 of Example 1 was subjected to homogenization and quenching treatment and to a tempering at 750°C for 30 minutes after a quenching, and was extruded by an extruding pressure of 12.5 tons, using a die with a reduction of area percentage of 50%. Its magnetic properties were isotropic and its magnetic characteristics were as follows:

Br = 3400 G $_{B}H_{C}$ = 2450 Oe (BH)max = $2.2 \times 10^6$ G. Oe

EXAMPLE 5

The rod shaped test specimen of Mn-Al alloy consisting of Mn 72.05% and Al 27.95%, as chemically analyzed, was cast, and from this casting, a cylindrical test piece of 20 mm$^{\phi}$ × 35 mm was cut out. It was subjected to quenching in water after holding it at 1000°C for 1 hour.

The alloy obtained by these treatments was examined by way of X-ray diffraction as to determine its phase structure, and was found to be in the $\epsilon$ phase only.

This alloy was tempered into the $\tau$ phase and was, then, upset at 700°C at deformation ratio 50% the specimen obtained by this working was found to be isotropic, and its magnetic characteristics were low as follows:

Br = 800 G $_{B}H_{C}$ = 550 Oe (BH)max = $0.1 \times 10^6$ G. Oe

As revealed by the X-ray diffraction of the test specimen after having been treated, a large amount of $\beta$ phase and $\gamma$ phase were recognized, but the $\tau$ phase was found only in a very small amount.

As clarified by the scores of examples described hereabove, in Mn-Al-C alloys with their composition range being limited to Mn 71.0~73.0%, C(1/10 Mn — 6.6)~(⅓ Mn — 22.2)% and remainder Al, by quenching in a temperature range of 830°~900°C at a cooling rate higher than 10°C/min., a tempering at 480°~750°C, after the quenching, and then, subjecting to plastic working in a temperature range of 550°~780°C, an isotropic permanent magnet having very excellent magnetic characteristics could be obtained.

Although such mechanisms as mentioned above have not yet clarified for the present, what is evident from those embodiments is that existence of carbon, in fine grainy or reticular shape of $Mn_3AlC$ and/or face-centered cubic phase similar to $Mn_3AlC$ and the presence of excess carbon, have an important effect on the characteristics of magnet.

According to this invention, isotropic magnets of very high performance which give (BH)max ranging to $(2.0 \sim 2.5) \times 10^6$ G. Oe are obtained. Their mechanical strengths were 10 times as high as those of the conventional isotropic Mn-Al-C alloys; they had such high toughness that they could be subjected to such machining as the ordinary lathing; they may be applied to not only upsetting, extruding and rolling, but also all plastic workings including ordinary plastic working such as drawing, forging, etc.; and it was easy to manufacture the magnets in any arbitrary shape; working speed in plastic deformation could be set arbitrarily.

They were thus of high industrial value.

What is claimed is:

1. A method of making an isotropic permanent magnet, which comprises the steps of:

1. preparing an alloy comprising the composition of 71.0% to 73.0% by weight of manganese, (1/10 Mn—6.6)% to (⅓ Mn—22.2)% by weight of carbon and remainder aluminum;
2. quenching the alloy from a temperature above 900°C at a cooling rate of higher than 10°C/minute in a temperature range of 830°C to 900°C;
3. tempering the quenched alloy at a temperature of 480°C to 750°C; and
4. plasticially deforming the tempered alloy at a temperature of 550°C to 780°C.

2. The method according to claim 1, wherein plastic deformation step (4) is performed by extrusion through a die.

3. The method according to claim 1, which comprises a step of additionally tempering the deformed alloy at a temperature of 480°C to 750°C.

4. An isotropic permanent magnet produced by the method of claim 1.

* * * * *